US007650845B2

(12) United States Patent
Vanoise et al.

(10) Patent No.: US 7,650,845 B2
(45) Date of Patent: Jan. 26, 2010

(54) DEVICE FOR PROTECTING A BOAT HULL

(76) Inventors: Jean Luc Vanoise, 47 rue du general Leclerc, 62120 Aire sur la Lys (FR); Alain Delepouve, 3 rue du Haut blé, 62330 Guarbecque (FR)

( * ) Notice: Subject to any disclaimer, the term of this patent is extended or adjusted under 35 U.S.C. 154(b) by 41 days.

(21) Appl. No.: 11/652,685

(22) Filed: Jan. 12, 2007

(65) Prior Publication Data

US 2007/0175376 A1 Aug. 2, 2007

(30) Foreign Application Priority Data

Jan. 13, 2006 (FR) ..... 06 00304

(51) Int. Cl.
*B63B 43/14* (2006.01)

(52) U.S. Cl. ..... 114/68; 114/219

(58) Field of Classification Search ..... 114/219, 114/123, 68

See application file for complete search history.

(56) References Cited

U.S. PATENT DOCUMENTS 2,571,856 A * 10/1951 Freedman ..... 433/80
3,774,720 A * 11/1973 Hovey ..... 182/91
5,340,508 A * 8/1994 Thompson ..... 261/122.1
5,829,376 A * 11/1998 Kostanski ..... 114/61.1
2004/0003766 A1* 1/2004 Mears et al. ..... 114/68

FOREIGN PATENT DOCUMENTS

| | | | |
|---|---|---|---|
| DE | 297 04 72 | U1 | 7/1997 |
| EP | 0 568 501 | A | 11/1993 |
| EP | 0 987 176 | A | 3/2000 |
| FR | 2 810 624 | A | 12/2001 |
| GB | 2091678 | A * | 8/1982 |

* cited by examiner

*Primary Examiner*—Stephen Avila
(74) *Attorney, Agent, or Firm*—Miles & Stockbridge P.C.

(57) ABSTRACT

A device for protecting a boat hull has an inflatable element with a deflated state, in which the element can be positioned either inside or outside of the boat hull. When located outside the hull, the inflatable element is operatively connected to an inflation/deflation circuit by a conduit. A translational control device causes the inflatable element to be selectively positioned between a position inside the hull and a position outside the hull. When outside the hull, the inflatable element may be inflated or deflated by the inflation/deflation circuit. A bushing provides a through opening in the hull through which the conduit and deflated element pass. A weighted plug is provided at the end of conduit and is shaped to provide sealing engagement with the bushing.

20 Claims, 2 Drawing Sheets

DEVICE FOR PROTECTING A BOAT HULL

FIELD OF THE INVENTION

The invention relates to a device for protecting a boat hull from impacts.

RELATED ART

When a boat is moored along a pontoon or a dock, in order to prevent damage to the hull, a device for protecting the hull is placed at different points along the side of the hull that faces the pontoon.

This protection device is in the form of a semi-rigid vertical fender hung from a rope secured, for example, to the railing.

These fenders are initially stowed inside the boat and must be put in place manually as the boat comes alongside, then stowed while the boat is in motion at sea or on a river.

Given that this operation is tedious and dangerous, there is a known device DE-A-297 04 772 or EP-A-0 987 176 that consists of providing housings in the hull of the boat in which inflatable protection devices are stored.

Each device is constituted by a deformable elastic membrane such that, deflated, it can be completely stowed in the housing, and in the inflated state, this device is approximately sphere-shaped. Each inflatable element is removably mounted on a nozzle of an inflation/deflation circuit that projects into the housing.

During inflation, the deformation of the wall of the device causes the protection device to emerge.

Such a system thus avoids the need for manual intervention and can be controlled remotely.

Although this system has its advantages, it requires these means to be provided during the building of the hull.

A second drawback is that these means are disposed at a specific level of the boat that does not necessarily correspond to the height of the pontoon or dock, given the tide.

A third point is that as the boat comes alongside, these devices are subjected to high shear stress, which tends to pull them off their nozzles.

Even when the boat is at a stop, these devices work under shear.

SUMMARY OF THE INVENTION

The invention proposes to eliminate these drawbacks in particular.

To this end, the subject of the invention is an inflatable device for protecting a boat hull, this device comprising an inflatable element, which in the deflated state is located inside the hull and in the deflated state is located outside the hull, this inflatable element being connected to an inflation/deflation circuit by a conduit, this protection device being characterized in that it comprises a translational control means that moves the inflatable element between an inside position and an outside position.

BRIEF DESCRIPTION OF THE DRAWINGS

The invention will be clearly understood with the aid of the description below, given as a nonlimiting example in reference to the drawing, which represents.

DESCRIPTION OF THE PREFERRED EMBODIMENTS

Figure 1:
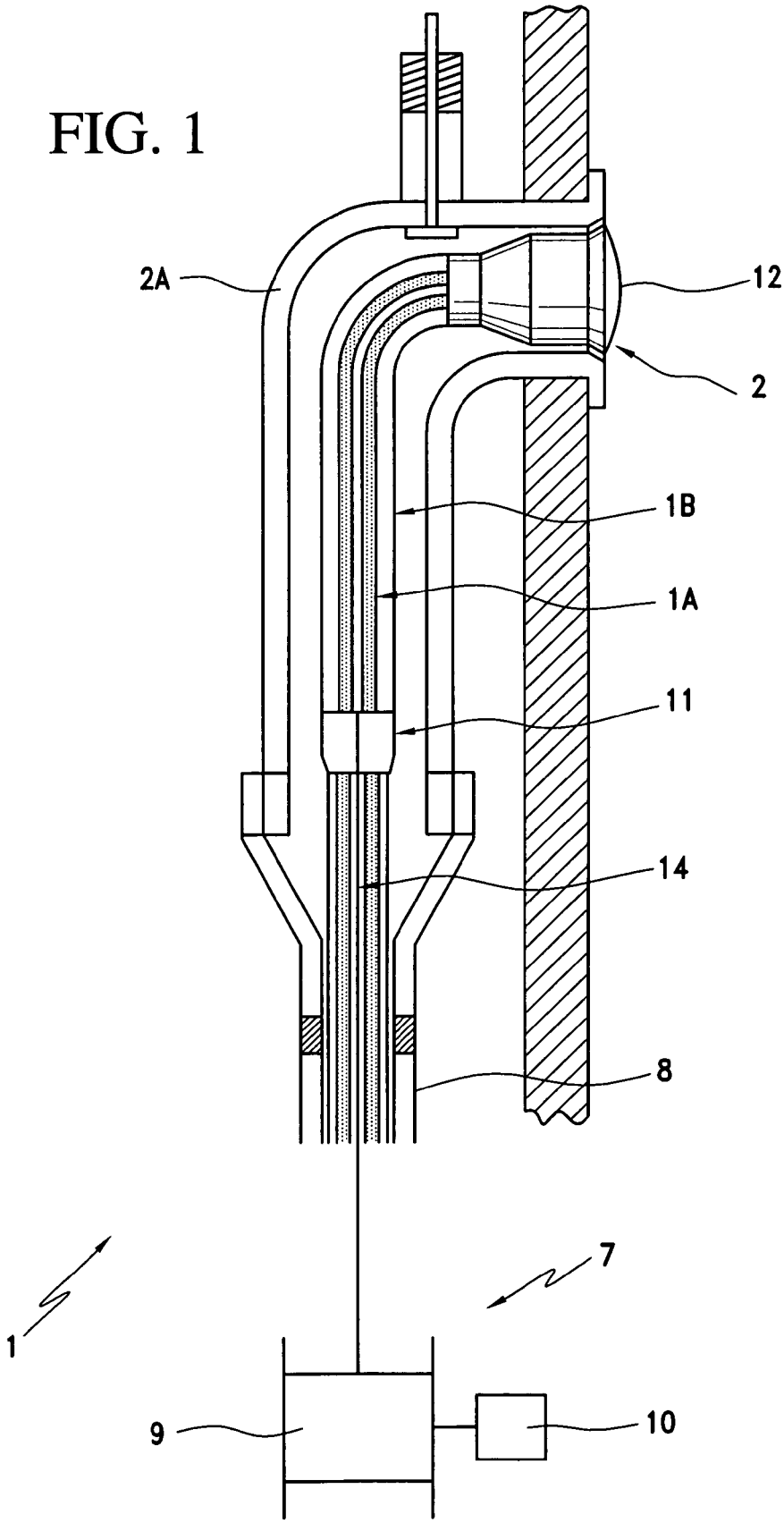
FIG. 1: A protection device in the return position.

Referring to the drawing, we see an inflatable device 1 for protecting a boat hull. This device must be deployed before the boat comes alongside the dock or the mooring pontoon.

Figure 2:
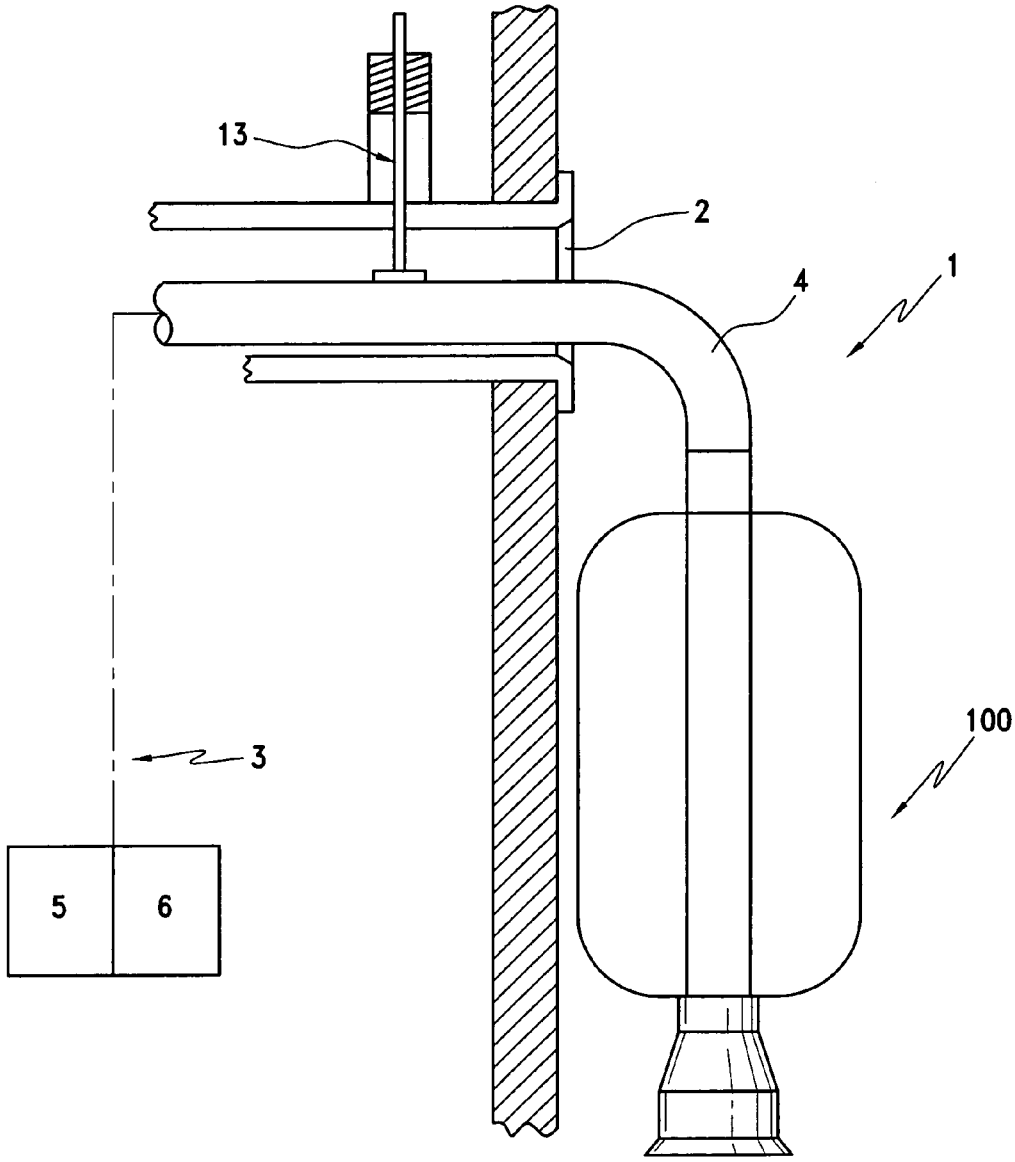
FIG. 2: The protection device in the deployed, inflated position.

This protection device 1 comprises an inflatable element 100 that is movable between a so-called inside position (FIG. 1) in which it is deflated and is located inside the hull, and a so-called outside position (FIG. 2) in which it is located outside the hull.

To this end, the hull has a pass-through opening 2, for example lined with a bushing 2A.

In order for it to be inflated and deflated, this protection device is connected to an inflation/deflation circuit by a conduit 4.

It uses, for example, a compressor 5 associated with a vacuum pump 6, possibly with a compressed air supply.

A distributor "D" makes it possible to connect the protection device to the compressor or the vacuum pump.

According to the invention, the protection device includes a translational control means 7 for moving the inflatable element selectively between the two aforementioned external and internal hull selectively positions.

The translational control for the device thus makes it possible to move it out of the hull and bring it to the outside at a desired level, i.e., higher or lower relative to the bridge of the boat or bring it completely within the hull. The translational control may be effected by a drum on which conduit 4 is wound and a reversible motor connected to drive the drum.

When the inflatable device is completely outside the hull, it can then be inflated.

Advantageously, air supply/evacuation conduit 4 for the inflatable device that moves the protection device 1.

The conduit 4 must therefore be able to exert both a pushing action and a pulling action.

In order for this conduit to act by pushing, it slides inside a sleeve 8 that is immobilized at each end inside the boat hull.

This conduit must also be flexible so that it can, for example, be wound onto a drum 9 moved by an electric motor 10.

Advantageously, the inflatable element 100 of the protection device is connected to the supply/evacuation conduit 4 by a fitting 11 that allows the inflatable element to rotate relative to the conduit.

This aspect is important because it makes it possible for the protection device to work by rotating rather than under shear.

Preferably, the inflatable element of the protection device is oblong in shape so that when deployed outside the hull, it protects the hull along a substantial height.

In the solution used, the protection device is composed of a flexible hollow central body 1A such as a flexible metal tube made of stainless steel, equipped with perforations "P" for the passage of air, this tube being surrounded by a deformable sheath 1B.

The supply conduit 4 comprises a traction-resistant element.

As may be seen in the drawing, the conduit 4 includes a flexible metal sheath, for example like the one used for the flexible tube only watertight; or this metal conduit can house a plastic conduit 14 like the one used for the pneumatic controls.

A cable may be used to strengthen the conduit 4.

This supply conduit 4 must have good tensile strength because when the protection device is deployed, it can be subject to substantial tensile stress.

Providing a fitting 11 that allows the inflatable element to rotate limits the stress on the conduit to primarily tensile stress.

Advantageously, the free end of the protection device is in the form of a plug 12 for closing the opening in the hull of the boat through which the protection device passes.

This plug 12 is lead-weighted so that it can assist the movement of the protection device in the outgoing direction. Locally, it can have a conical neck 15 for proper sealing, which could be supplemented by a gasket 16.

This plug also holds the device in position vertically when it is pulled out by the effect of gravity.

Since, as may be seen, the bushing is bent so as to make part of the device and the conduit parallel to the hull.

A translational locking mechanism or means 13 of the supply conduit is represented schematically.

This could involve a rotational locking of the drum onto which the supply conduit is wound, but it could also involve a pressure system located as close as possible to the opening in the hull.

It is possible to provide an indicator of the unfurled length of the line that connects the protection device to the drum, in order to read the position of the inflatable element relative to the bridge from a remote device.

Thus, it is possible to deploy these protection devices, also known as fenders, from a control point without the risk of falling in the water, which is quite advantageous for persons of limited mobility.

One or more of these devices are distributed along the hull as necessary.

The invention claimed is:

1. A boat hull protection device comprising:

an inflatable element having an inflated state and a deflated state and configured so as to be positionable both inside a hull and outside the hull in the deflated state and positionable entirely outside the hull in the inflated state;

an air supply/evacuation conduit connecting said inflatable element to an inflation/deflation circuit, the air supply/evacuation conduit being configured to convey air from the inflation/deflation circuit into the inflatable element so as to inflate the inflatable element to the inflated state, and to convey air out of the inflatable element so as to deflate the inflatable element to the deflated state; and a translational control device connected to said inflatable element by the air supply/evacuation conduit, the translational control device being configured to move the inflatable element in the deflated state between a first position inside the hull and a second position outside the hull by displacing the air supply/evacuation conduit.

2. A protection device according to claim 1, wherein the translational control device includes a drum and an electric motor to drive said drum, at least a portion of the air supply/evacuation conduit being wound around said drum.

3. A protection device according to claim 1, further comprising a bushing forming an opening in the hull through which the air supply/evacuation conduit passes, wherein the inflatable element is configured to move translationally through the bushing in the deflated state.

4. A protection device according to claim 1, wherein the inflatable element is oblong in shape.

5. A protection device according to claim 1, further comprising a fitting which connects the inflatable element to the air supply/evacuation conduit such that the inflatable element is rotatable relative to the air supply/evacuation conduit.

6. A protection device according to claim 1, further including a sleeve immobilized at each of its ends inside the hull, the air supply/evacuation conduit being arranged to slide inside said sleeve.

7. A protection device according to claim 1, wherein the inflatable element comprises a flexible central body surrounded by a deformable sheath.

8. A protection device according to claim 1, wherein the air supply/evacuation conduit includes a flexible metal sheath.

9. A protection device according to claim 1, wherein said air supply/evacuation conduit is constructed to alternately exert a pushing force on the inflatable element so as to move the inflatable element in the deflated state from the first position to the second position and a pulling force on the inflatable element so as to move the inflatable element in the deflated state from the second position to the first position.

10. A protection device according to claim 1, further comprising a locking device that locks a position of the inflatable element.

11. A protection device according to claim 1, further comprising a plug arranged proximal to a free end of the inflatable element, wherein said plug includes a conical neck region.

12. A protection device according to claim 1, further including a locking device that locks a position of the inflatable element, said locking device arranged proximal to the bushing inside the hull.

13. A protection device according to claim 3, wherein the second position outside the hull is at a height below that of the opening in the hull.

14. A protection device according to claim 1, wherein the second position outside the hull is adjacent to an external surface of the hull.

15. A boat hull protection device comprising:

an inflatable element having an inflated state and a deflated state and configured so as to be positionable both inside a hull and outside the hull in the deflated state and positionable entirely outside the hull in the inflated state;

an air supply/evacuation conduit connecting said inflatable element to an inflation/deflation circuit;

a translation control device that moves the inflatable element in the deflated state between a first position inside the hull and a second position outside the hull;

a bushing forming an opening in the hull through which the air supply/evacuation conduit passes, the inflatable element being configured to move translationally through the bushing in the deflated state; and a plug arranged proximal to a free end of the inflatable element, the plug being configured to seal said bushing when the inflatable element is in the first position.

16. A protection device according to claim 15, wherein the translational control device is configured to move the inflatable element by displacing the air supply/evacuation conduit.

17. A protection device according to claim 15, wherein the air supply/evacuation conduit includes a flexible metal sheath.

18. A protection device according to claim 15, further comprising a fitting which connects the inflatable element to the air supply/evacuation conduit such that the inflatable element is rotatable relative to the air supply/evacuation conduit.

19. A protection device according to claim 15, further comprising a sleeve immobilized at each of its ends inside the hull, the air supply/evacuation conduit being arranged to slide inside said sleeve.

20. A protection device according to claim 15, further comprising a locking device that locks a position of the inflatable element.

* * * * *